US007253563B2

(12) United States Patent
Nakazato et al.

(10) Patent No.: US 7,253,563 B2
(45) Date of Patent: Aug. 7, 2007

(54) METAL HALIDE LAMP

(75) Inventors: Keisuke Nakazato, Ehime (JP); Hidehiko Noguchi, Ehime (JP); Koji Tanabe, Ehime (JP); Makoto Deguchi, Ehime (JP)

(73) Assignee: Harison Toshiba Lighting Corporation, Ehime (JP)

( * ) Notice: Subject to any disclaimer, the term of this patent is extended or adjusted under 35 U.S.C. 154(b) by 86 days.

(21) Appl. No.: 11/226,449

(22) Filed: Sep. 15, 2005

(65) Prior Publication Data

US 2006/0119273 A1 Jun. 8, 2006

(30) Foreign Application Priority Data

Dec. 3, 2004 (JP) ..... 2004-350954
Dec. 3, 2004 (JP) ..... 2004-350955
Aug. 30, 2005 (JP) ..... 2005-249463

(51) Int. Cl.
*H01J 17/16* (2006.01)

(52) U.S. Cl. ..... 313/634; 313/317; 313/567; 313/623

(58) Field of Classification Search ..... 313/634, 313/317, 567, 623
See application file for complete search history.

(56) References Cited

U.S. PATENT DOCUMENTS 7,057,348 B2 * 6/2006 Miyazawa ..... 313/634
2003/0173901 A1 * 9/2003 Miura et al. ..... 313/634

FOREIGN PATENT DOCUMENTS

JP 53097279 A * 8/1978
JP 2003187745 * 7/2003
JP 2003229058 * 8/2003

* cited by examiner

*Primary Examiner*—David Bruce
*Assistant Examiner*—Rachelle Harding
(74) *Attorney, Agent, or Firm*—Banner & Witcoff, Ltd.

(57) ABSTRACT

A metal halide lamp includes a translucent air tight vessel having a light emitting tube portion with an internal discharge space, and sealing portions formed on both sides. A discharge medium in the discharge space contains at least metal halide and rare gas. A pair of electrodes, one ends of which are sealed at sealing portion and the other end of which are arranged in the discharge space facing each other. The discharge space has a nearly circular shape in a cross section perpendicular to the tube axis and has a structure in which the discharge medium is accumulated between the electrodes. The light emitting tube portion has a wall thickness of a lower portion thinner than that of an upper portion. The metal halide lamp has a high luminous efficiency, a quick rise of light flux and an easy manufacturing ability.

8 Claims, 4 Drawing Sheets

METAL HALIDE LAMP

TECHNICAL FIELD

The present invention relates to a structure of a halide lamp used for headlights of automobiles.

BACKGROUND TECHNOLOGY OF THE INVENTION

As a conventional technology, for example, a high-pressure gas discharge lamp with following structure is disclosed in Japanese Patent Official Gazette laid open No. 2003-187745. The high-pressure gas discharge lamp is provided with a discharge vessel enclosing a discharge space and a light generating substance. The bottom surface of the discharge vessel has a raised first region near an arc formed during lighting, and a second region for storing light generating substance which is moved by the heat during lighting.

In the high-pressure gas discharge lamp mentioned above, the temperature of the bottom surface coolest in the discharge vessel is raised by making the distance between the arc discharge formed during lighting and the bottom surface of the discharge space Shorter. In this situation, temperature balance in the discharge vessel is controlled so well that a high luminous efficiency can be attained and a lighting voltage can also be increased.

A method for manufacturing the above-mentioned high-pressure gas discharge lamp is disclosed in Japanese Patent Official Gazette laid open No. 2003-229058.

However, in the conventional high-pressure gas discharge lamp, the discharge space of the discharge vessel becomes a special and non circular shape due to the structure in which the distance between the arc discharge and the bottom surface of the discharge space is reduced and light generating substance moving by being heated must be accumulated. For this reason, the following problems take place.

First, light generating substance an move rather freely on the bottom surface of the discharge vessel by heat, depositing position or amount of deposition of the light generating substance always fluctuates and is difficult to be fixed at a definite value. Therefore, vaporizing speed etc. of the light generating substance vary widely, and thus an initial rise time of light flax or chroma after lighting of the lamp vary every time the lamp is switched on.

Second, because or the particular shape of the discharge space, convection of vapor of the light generating substance varies complicatedly making the discharge unstable. For this reason, luminance distribution is changed, so that designing of the lighting device becomes difficult.

Third, because the manufacturing of the lamp having a discharge space having such a special shape is difficult, a special manufacturing method should be employed. Further, if the discharge vessel having a little bit deformed from the designed shape is made, fluctuation in lamp characteristics might arise.

SUMMARY OF THE INVENTION

One of the objects of the present invention is to supply a metal halide lamp with a high luminous efficiency, with a quick rise of light flux, easy to manufacture, and having less influence on lamp characteristics.

According to an aspect of the present invention, a metal halide lamp according to the present invention is provided with a translucent air tight vessel having a light emitting tube portion in which a discharge space is formed and sealing portions formed on both ends of the light emitting tube. In the discharge space, a discharge medium containing at least a metal halide and a rare gas is enclosed. The metal halide lamp is also provided with a pair of electrodes sealed at the sealing portions and each one end of the electrodes is arranged facing to each other in the discharge space.

The discharge space in the above mentioned light emitting tube is formed in a shape described below. A shape in a cross section perpendicular to a tube axis of the light emitting tube is nearly circular. A shape of a bottom portion in a vertical cross section along the tube axis of the light emitting tube is nearly parallel to the tube axis having a lowest level at a portion between the pair of electrodes, and is rising in a tapered shape at both ends of the portion. Owing to the shape of the discharge space, the discharge medium fluidized or solidified can be accumulated on the bottom portion of the light emitting tube while the lamp is lighted or not. Moreover, in the metal halide lamp according to the present invention, wall thickness of the bottom portion of the light emitting tube is formed thinner than that of the ceiling portion.

In the metal halide lamp according to the present invention having such structure, the rise of the light flux becomes quick because the discharge medium is always accumulated on the bottom of the discharge space at the portion between the pair of electrodes. Moreover, the luminous efficiency becomes high because the wall thickness at the bottom portion of the light emitting tube is formed to be thinner than that of the ceiling portion. Further, manufacturing is easy because the shape of the discharge space is nearly rotationally symmetrical to the tube axis. Further, influence on the lamp characteristics can be minimized because the fluctuation of the shape of the discharge space during manufacturing is less.

DETAILED DESCRIPTION OF THE INVENTION

Hereinafter, an embodiment of a metal halide lamp according to the present invention will be explained in detail referring to the figures attached.

First Embodiment

Figure 1:
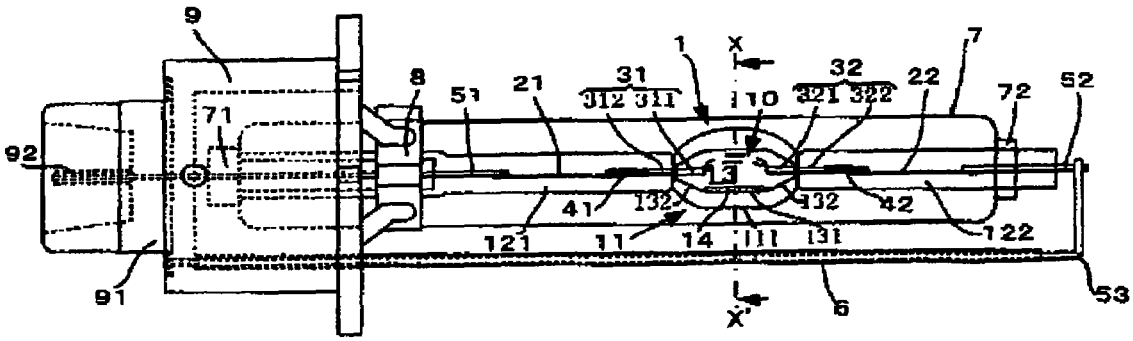
FIG. 1 is a side view showing an inner structure of a metal halide lamp according to an embodiment of the present invention.
Figure 2:
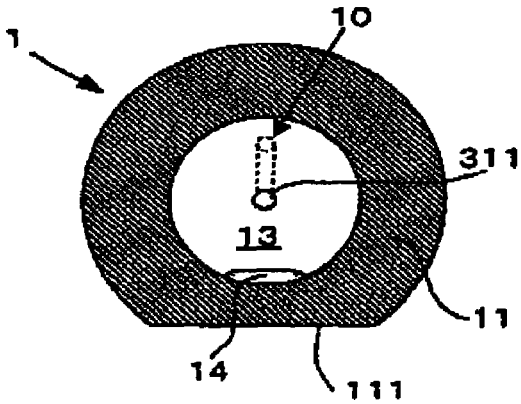
FIG. 2 is a cross section of a light emitting tube portion of the metal halide lamp shown in FIG. 1, which is cut along the line X-X' perpendicular to the tube axis shown in FIG. 1 and seen from an arrow direction.
Figure 3A:
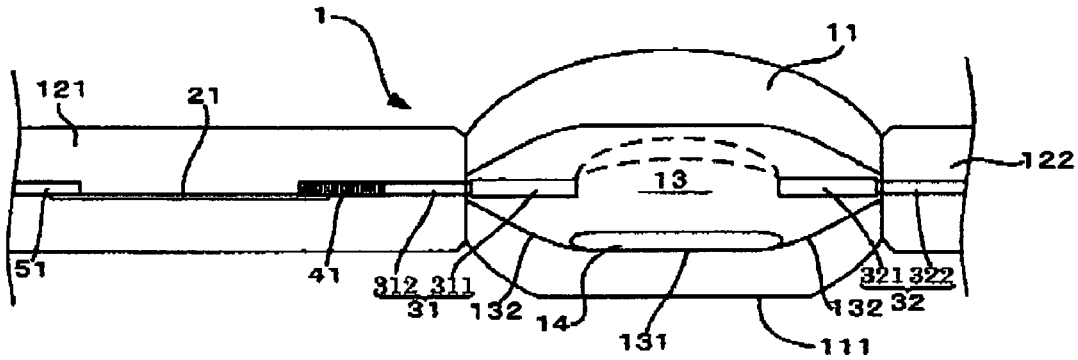
FIG. 3*a* and FIG. 3*b* are side view showing a relation between a flat surface and a sealing portion of the metal halide lamp shown in FIG. 1 showing the inner structure as well.
Figure 3B:
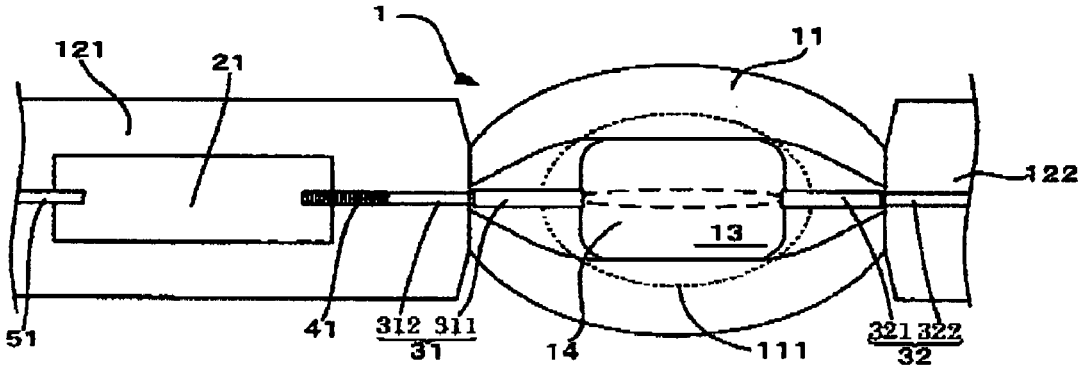

FIG. 1 is a side view showing an inner structure of a metal halide lamp which is a first embodiment of the present invention. FIG. 2 is a cross section of a light emitting tube portion of the metal halide lamp shown in FIG. 1, which is cut along the line X-X' perpendicular to the tube axis shown in FIG. 1 and seen from a direction of arrows shown in the drawing. Further, FIG. 3*a* and FIG. 3*b* are side view showing a relation between a flat surface and a sealing portion of the metal halide lamp shown in FIG. 1 showing the inner structure.

An air tight vessel 1 is composed of a light emitting tube portion 11 having a shape of a rotational ellipsoid as a whole and being made of, for example, a translucent fused quartz, and sealing portions 121, 122 provided at both ends of the light emitting tube portion 11 in a longitudinal direction of the rotational ellipsoid and made of the same material with the light emitting tube portion 11. On the outside of the light emitting tube portion 11, a flat surface 111 is formed at its lower portion. Inside the light emitting tube portion 11, a discharge space 13 with a volume of less than 0.1 cc is formed. The shape of the discharge space 13 in the vertical section along the tube axis is composed of a linear horizontal portion 131 and tapered portion 132 on the both sides of the linear horizontal portion 131. The linear horizontal portion 131 is at lowermost position to the tube axis, and the tapered portion 132 is gradually rising close to the tube axis.

In the discharge space 13, metal halides such as sodium iodide, scandium iodide, zinc iodide and a rare gas such as xenon are enclosed as a discharge medium 14. The major portion of the discharge medium 14 is always accumulated and heaped up at the horizontal portion 131 at the bottom portion of the discharge space while a lighting time of the lamp.

Function of the each component of the discharge medium 14 is explained. Sodium metal contained in sodium iodide and scandium metal contained in scandium iodide act as light generating metal. Zinc metal contained in zinc iodide acts as a lamp voltage generating medium in place of mercury. Xenon acts mainly as a starting gas. The iodine having less reactivity than other halides is most suitable.

Here, mercury is not substantially contained in the discharge medium 14 enclosed in the light emitting tube portion 11. Containing substantially no mercury means that it does not contain mercury at all or contains less than 2 mg/cc or preferably contains less than 1 mg/cc of mercury. For example, the conventional short arc type lamp containing mercury encloses 20 to 40 mg/cc, sometimes more than 50 mg/cc of mercury in order to make the lamp voltage to be a necessary high voltage by mercury vapor. Compared with the mercury amount, less than 2 mg of mercury is overwhelmingly scarce, and thus it can be said that substantially no mercury is contained.

Next, the sealing portions 121, 122 are formed, for example, by pinch sealing, with which the sealing portions 121, 122 consist of a pair of flat pinch surfaces and a pair of side surfaces corresponding to their thick portion. Inside the sealing portions 121, 122, metal foils 21, 22, made of molybdenum, for example, are sealed. On one end of the metal foil 21, 22, of the discharge space 13 side, one end of electrode 31, 32, made of tungsten, for example, is connected by resistance welding. The electrode 31 is formed with a large diameter portion 311 and small diameter portion 312, which are connected into one body. The electrode 32 is similarly formed with a large diameter portion 321 and a small diameter portion 322, which are connected into one body. The other ends of the electrodes 31, 32 are respectively extended into the discharge space 13 through the sealing portion 121, 122 near the light emitting tube section 11, and their ends are so arranged to face each other keeping a prescribed inter-electrode distance. The prescribed inter-electrode distance is about 4.2 mm when used for headlights of automobiles, about 2 mm for projection use. That is, less than 5 mm is suitable for short arc type lamp such as the lamp according to the present invention.

On the small diameter portions 312, 322 of the electrodes 31, 32, coils 41, 42 which are formed by winding metallic conducting wire with several turns, the outer periphery of which are in contact with and are connected with the metal foils 21, 22. These coils 41, 42 are enclosed in the sealing portions 121, 122.

Lead-in conductors 51, 52 are connected to the opposite end of the metal foils 21, 22, to the end, to which the electrodes 31, 32 are connected by welding etc. Other end of the lead-in conductor 52 is led out of the sealing portion 122, and is connected with an end of "L" shaped power supply terminal 53, which extends vertically and crosses the vertical end with nearly right angle. The other end of the power supply terminal 53 horizontally extends in nearly parallel to the sealing portions 121, 122 toward the lead-in conductor 51. The portions extending in parallel with the sealing portions 121, 122 of the power supply terminal 53 are covered with an insulating tube 6, for example, made of ceramics.

Another lead-in conductor 51 is extended to the opposite direction to the lead-in conductor 52 with respect to the light emitting tube portion 11. The end of the lead-in conductor 51 is connected electrically with a metal terminal 92 at the bottom portion of the socket 9 extending through the socket 9.

The air tight vessel 1 including the sealing portions 121, 122, is contained in a tubular outer tube 7 made of a material, which cut-off an ultraviolet ray, for example. That is, the outer tube 7 is provided so as to cover the air tight vessel 1 including the sealing portions 121, 122 extending along the longitudinal direction. On both ends of the longitudinal outer tube 7, reduced diameter portions 71, 72 are formed. The air tight vessel 1 is glass welded at the reduced diameter portion 71, which is on the side of the sealing portion 121. The air tight vessel 1 is glass welded at another reduced diameter portion 72, which is on the side of sealing portion 122.

The outer tube 7 containing the air tight vessel 1 inside is fixed with the socket 9 by a fixing metal part 8 arranged so as to pinch the outer periphery surface of the air tight vessel 1. On the reduced diameter portion of the socket 9, a metal terminal 91 is formed along the outer periphery surface. On the bottom surface of the socket 9, a metal terminal 92 is formed. The lead-in terminal 51 is electrically connected to the metal terminal 91.

In the metal halide lamp thus constructed, an arc 10 is formed during the lighting of the lamp, which is bent upward from a straight line extending between the axes of the electrode 31, 32, as shown by the dotted line in FIG. 1 or FIG. 3.

Then, the light emitting tube portion 11 will be described in more detail referring to FIG. 2. Inside the light emitting tube portion 11, a discharge space 13 having a circular cross section cut by a plane perpendicular to the tube axis is formed, in which the discharge medium 14 is accumulated on the bottom portion of the discharge space 13. At the center of the discharge space 13, an end of the large diameter portion 311 of the electrode 31 is situated. The outer shape of the light emitting tube portion 11 is nearly circular, which is concentric with the discharge space and which has the flat surface 111 formed on the lower portion.

A method for forming the flat surface 111 will be explained. The flat surface 11 is formed by cutting the lower portion of the light emitting tube portion 11 using a laser, for example, after the manufacturing process of the light emitting tube portion 11 is completed. This is so-called a bulb cut process. Here, "after the the light emitting tube portion 11" means the process right after the light emitting tube portion 11 is built or the sealing portions 121, 122 were provided on it and the air tight vessel 1 was completed. Further, even after the metal halide lamp is completed is meant.

The flat surface 111 is preferably built in parallel with the pinch surface of the sealing portions 121, 122, as shown in FIG. 3*a* or FIG. 3*b*. The reason is as follows. If the flat surface 111 is orthogonal to the pinch surface, bulb cut process is disturbed by the pinch surface and becomes difficult to form the lower wall thinner than a prescribed dimension. Here, "the pinch surface" means a surface of a larger area in the sealed portions 121, 122 which are crushed flatly in pinch seal process. This surface is not limited to a flat surface, but may be a surface with a concave or a convex portion is formed. Here, the flat surface of the metal foils 21, 22 are parallel with the flat surface 111 of the light emitting tube portion 11, because they are so enclosed in the sealed portions 121, 122 as to be in parallel with the pinch surface by the pinch seal process.

Completing the process for forming the flat surface 111, it is preferable to provide a polishing process to polish the cut surface of the light emitting tube portion 11. With the process, transparency of the flat surface 111 can be increased, to minimize the loss of light transmission.

Figure 4:
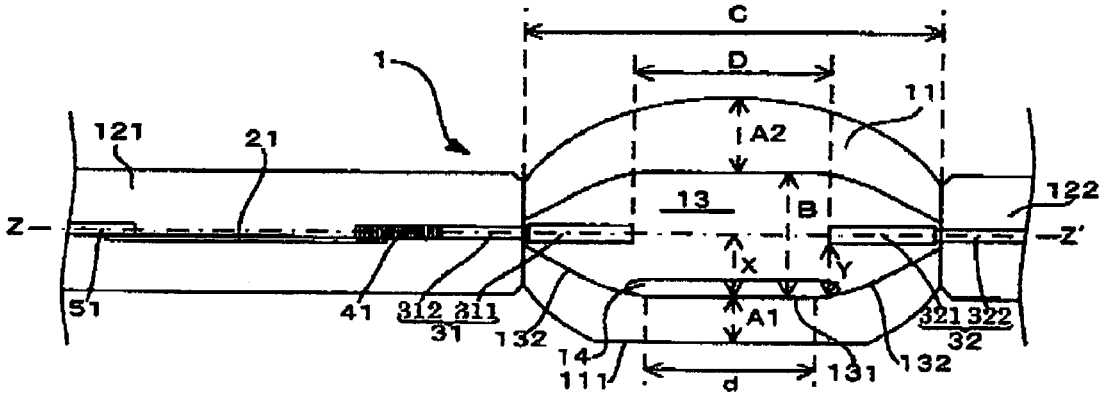
FIG. 4 is an enlarged side view showing the inner structure in the vicinity of light emitting tube portion in order to indicate the dimension of the light emitting tube portion of the metal halide lamp shown in FIG. 1.

FIG. 4 is a partially enlarged side view indicating example dimensions of the light emitting tube portion forming the metal halide lamp shown in FIG. 1. The diameter of the large diameter portions 311, 321 of the electrode 31,32 is 0.35 mm, and the diameter of the small diameter portions 312, 322 is 0.3 mm. The wall thickness A2 of high temperature side, i.e., the ceiling portion of the light emitting tube portion 11 is 1.85 mm. The inner diameter B is 2.4 mm. The maximum length C of the longitudinal direction of the light emitting tube portion 11, i.e., the direction of the tube axis Z-Z' is 8.0 mm and the inter electrode distance D is 4.2 mm. The light emitting tube portion 11 contains 0.5 mg of scandium iodide-sodium iodide-zinc iodide, which are metal halides, and 10 atm of xenon which is a rare gas are enclosed as the discharge medium 14 but does not contain mercury.

Figure 5A:
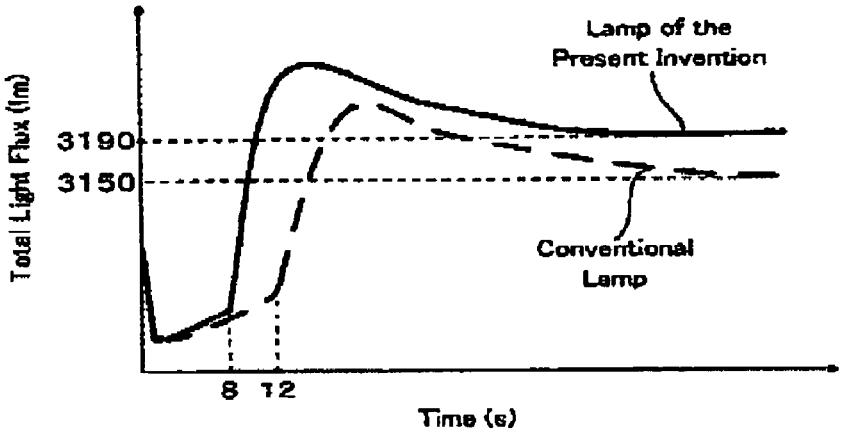
FIG. 5*a* and FIG. 5*b* are characteristic diagrams showing performance characteristics of the metal halide lamp shown in FIG. 1 comparing with the conventional lamp.
Figure 5B:
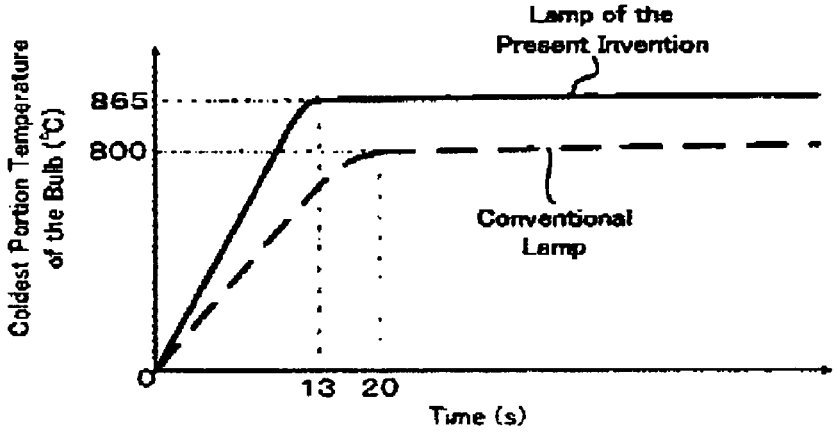

A comparison test of lamp characteristics was performed between the lamp according to the present invention and the conventional lamp. In the light emitting tube portion 11 on which a flat surface 111 is formed according to the present invention, the wall thickness A1 of the bottom portion is 1.00 mm and the wall thickness A2 of the ceiling portion is 1.85 mm. In the conventional lamp having no flat surface on the light emitting tube portion, the wall thicknesses A1 and A2 are equal and are 1.85 mm. FIG. 5*a* and FIG. 5*b* are diagrams for explaining the result of the comparison test. Here, FIG. 5*a* is a graph indicating the light flux rise characteristics of the lamp of the present invention and of the conventional one, and FIG. 5*b* is a graph indicating the temperature rise characteristics at the bottom portion of the light emitting tube portion, i.e., the coldest portion.

As it is clear from FIG. 5*a*, in the lamp according to the present invention, a difference of about 50 lm in the total light flux is seen at stable lighting, compared with the conventional lamp, which is a significant improvement in luminous efficiency. This is related with the fact that the coldest temperature at the bottom of the light emitting tube portion 11 becomes higher by 65° than that of the conventional one, as shown in FIG. 5*b*. Here, the following two factors are assumed for the reasons why the bottom temperature of the light emitting tube portion 11 of the lamp according to the present invention becomes higher. First, the heat capacity of the coldest portion at the bottom decreases by reducing the wall thickness at the bottom of the light emitting tube portion 11. Second, an amount of heat loss through the gas between the outer tube and the air tight vessel 1 decreases, because the outer shape at the bottom portion of the light emitting tube portion 11 is flat instead of spherical and the surface area exposed in the atmosphere is reduced.

With respect to the light flux rise curve at the time right after lighting, the lamp according to the present invention shows a quicker rise as a whole than the conventional lamp, as clearly shown in FIG. 5*a*. Especially, the lamp according to the present invention shows a rapid rise with a rise time of about 8 sec. On the other hand, the conventional lamp shows a slow rise with a rise time of about 12 sec., which is longer than the rise time of the present invention by 4 sec. It can be assumed that the discharge medium contributes to light emission from the early stage of the lighting of the lamp according to the present invention since the temperature at the bottom portion of the light emitting tube portion 11 rises quicker than the conventional one as shown in FIG. 5*b*, and thus the temperature in the light emitting tube portion 11 rapidly reaches to the vaporizing temperature of discharge medium such as sodium or scandium.

Here, in the lamp according to the present invention, the high luminous efficiency shown in FIG. 5*a* is obtained only when the major portion of the discharge medium 14 is accumulated at the lower portion between the electrodes in the discharge space 13. The reason is that heat is not transmitted to the discharge medium 14 effectively, if the discharge medium 14 is not accumulated at the lower portion between the electrodes in the discharge space 13 and thus not only the rise of the light flux becomes slow but also the light flux rise time fluctuates from time to time when the lamp is lit.

For an inner structure of the light emitting portion 11 for accumulating the discharge medium 14 between a pair of electrodes 31, 32, the following structure is preferable, for example. When the distance from the center between the end of the electrodes 31, 32 to the bottom portion of the discharge space 13, i.e., the linear horizontal portion 131 is defined as X and the distance from each end of the electrodes 31, 32 to the bottom of the discharge space 13 is defined as Y, the relation between X and Y is expressed as the formula;

$$X \geqq Y$$

or more preferably, as the formula;

$$X>Y$$

This means that the horizontal portion 131 is in the lowest position from the level of the tube axis Z-Z'. On both sides of the horizontal portion 131, the tapered portion 132 is formed, in which the bottom portion rises as it gradually approaches to the level of the tube axis.

Further, an exemplary structure for accumulating the discharge medium 14 between the electrodes 31, 32, is provided, in which the bottom portion of the discharge space 13 is nearly parallel to the tube axis as shown in the embodiment of the present invention. That is, when the length of the horizontal portion 131 along the axis is defined as d, and the distance between the end of the electrodes 31, 32 is defined as D, the relations between d and D is expressed as the following formula;

$$d \leqq D$$

and more preferably, it is expressed as the following formula;

$$d<D$$

Here, if the dimensions of the structure meets the above formula, the shape of the bottom of the discharge space 13 along the tube axis Z-Z' is not limited to horizontally linear as shown in the present embodiment, but it may be a curved surface in which near the central portion of the discharge space is deepest.

Figure 6:
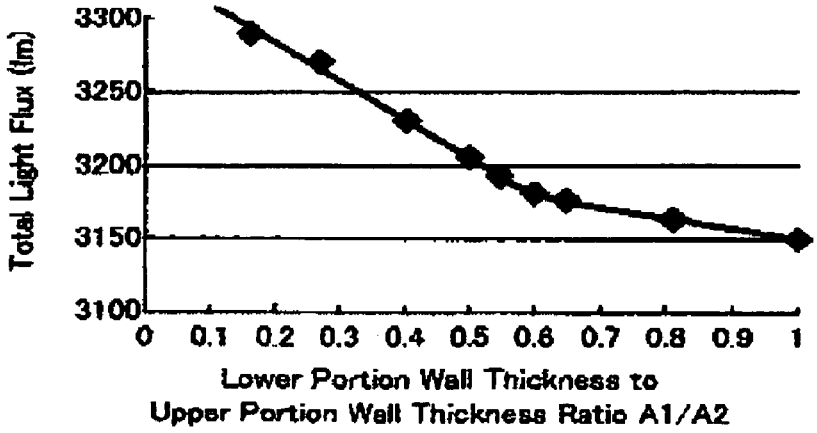
FIG. 6 is a lamp characteristics diagram indicating a measured result of a total light flux emitted from the lamp when a wall thickness of the bottom portion of light emitting tube portion of the metal halide lamp shown in FIG. 1 is changed.

FIG. 6 is a graph showing a total light flux of a plurality of lamps, each of which has a structure shown in FIG. 4 with the wall thickness of the bottom portion of the light emitting tube portion 11 varied by changing the location of the flat surface and each of which is lit with a power of 35 W.

As it is clear from the figure, when a wall thickness ratio of the bottom portion to the ceiling portion A1/A2=1, i.e. when the both walls have the same thickness, total light flux is 3150 lumen (lm) and when the wall thickness A1 of the bottom portion decreases, total light flux increases. Here, when A1/A2 ratio becomes more than 0.8, a degree of total light flux rise becomes less. When A1/A2 ratio becomes less than 0.2, the mechanical strength of the bottom portion of the light emitting tube is degraded. Therefore, A1/A2 ratio is preferable in the range expressed in the following formula;

$$0.2 \leqq A1/A2 \leqq 0.8$$

It is more preferable for A1/A2 ratio to be in the range expressed in the following formula;

$$0.2 \leqq A1/A2 \leqq 0.65$$

In the range, an increase in the total light flux is expected.

Next, a life test of metal halide lamp for automobile headlights specified by Japan Electric Lamp Manufacturers Association, which is a flash on and off test on EU120 min. mode, was performed with the lamp, on which a flat surface 111 is formed at the light emitting tube portion 11. It was confirmed that the life did not end after a lapse of 2000 hours.

This test result shows an extremely important fact for the metal halide lamp according to the present invention. That is, it has been believed that the life of the lamp is made short in such a metal halide lamp as in the embodiment of the present invention, in which a part of the wall thickness of the light emitting tube portion is reduced, because the mechanical strength of the light emitting tube itself is degraded causing expansion at the thin wall portion due to a heavy load and high temperature of the lamp. However, it was confirmed by the test result that a life characteristics for the practical use level is obtained and such problem does not occur.

Therefore, according to the present embodiment, the rise of the light flux can be made quick and the total light flux can be increased by forming a flat surface 111 on the bottom portion of the light emitting portion 11 and making the wall thickness of the bottom portion less than that of the ceiling portion.

Further, the discharge medium 14 can always be accumulated at definite position with a definite amount because the shape of the discharge space 13 formed inside the light emitting tube portion 11 is nearly circular in the cross section perpendicular to the tube axis. With the structure, the fluctuation in the rise of light flux or lamp characteristics of chroma can be minimized. Furthermore, the manufacturing of the lamp becomes easy because the shape of the discharge space 13 is nearly circular in the cross section perpendicular to the tube axis and is symmetric with the tube axis.

Further, the arc is apt to be stabilized and therefore a stable discharge can be obtained because the electrodes 31, 32 are located at the center of the discharge space 13 in the cross section perpendicular to the tube axis.

Further, the manufacturing of the lamp is also very easy with the wall thickness of the bottom of the light emitting tube portion being adjusted freely when needed, because the flat surface 111 at the outer lower portion of the light emitting tube portion 11 can be manufactured by cutting the light emitting tube portion 11 after it is formed.

Further, in the lamp according to the above embodiment, the whole air tight vessel 1 can easily be moved down to offset the electrodes 31, 32 to downward of a base axis of the socket 9 when the air tight vessel 1 is fixed in accordance with the base axis of the socket 9, because a larger space is formed in the vicinity of the bottom portion than in the vicinity of the ceiling potion. By employing this structure, light distribution can be improved in the lamp in which arc 10 is curved during lighting, because the arc 10 can be arranged at the focal point of a reflecting mirror of the lighting device for automobiles.

Second Embodiment

Figure 7A:
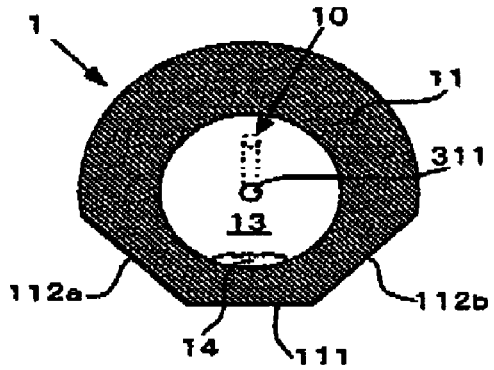
FIG. 7*a*, FIG. 7*b*, and FIG. 7*c* are cross section views perpendicular to the tube axis of the light emitting tube portion showing the second embodiment of the metal halide lamp according to the present invention.
Figure 7B:
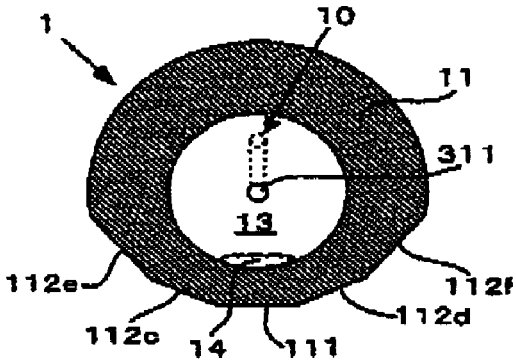
Figure 7C:
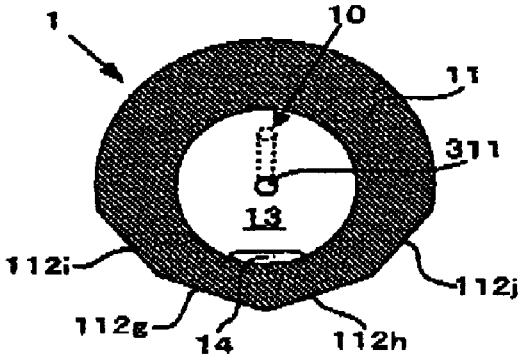

FIG. 7*a* to FIG. 7*c* are cross section views for showing a metal halide lamp according to a second embodiment of the present invention. In the figures, the same parts as those in the metal halide lamp shown in FIG. 2 are designated by the same symbols and detailed explanations are omitted. In the second embodiment, it is characterized that the outer lower portion of the light emitting tube portion 11 is made in a polyhedral shape.

In the embodiment shown in FIG. 7*a*, the bottom portion of the light emitting tube portion 11 is composed of a flat surface 111 and inclined flat surfaces 112*a*, 112*b* which are continuously formed with the flat surface 111.

In the present embodiment, owing to a polypheric shape composed of the flat surface 111 and the inclined flat surface 112*a*, 112*b*, the heat capacity of the bottom portion can be decreased compared with the case of flat surface 111 only. Owing to the structure, reduction of the rise time of the light flux and a further improvement in the total light flux of the lamp can be expected.

Further, in the embodiment shown in FIG. 7*b*, the shape of the outer lower portion of the light emitting tube portion 11 is formed by the bottom flat surface 111 and a plurality of inclined flat surfaces 112*c* to 112*f* arranged on both sides of the bottom flat surface 111 upward to a central portion of the light emitting tube portion 11, in which wall thicknesses of the flat surfaces 112*c* to 112*f* are gradually increasing from bottom portion to the central portion of the light emitting tube portion 11.

Further, in the embodiment of FIG. 7*c*, a flat surface 111 is not formed at the bottom portion of the light emitting tube portion 11, but the outer surface is formed by inclined flat surfaces 112*g* to 112*j* only.

Third Embodiment

Figure 8:
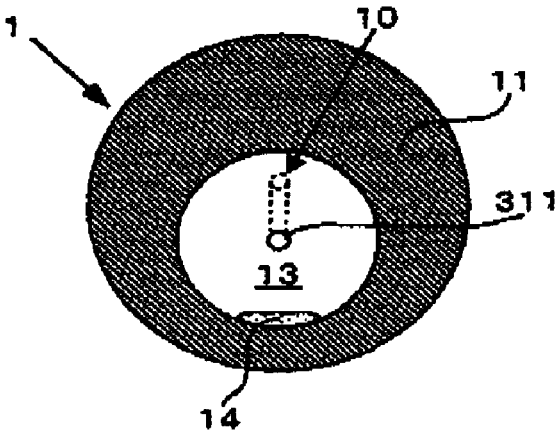
FIG. 8 is a cross section view perpendicular to the tube axis of the light emitting tube portion showing the third embodiment of the metal halide lamp according to the present invention.

FIG. 8 is a cross section view for showing a metal halide lamp according to a third embodiment of the present invention. In the figure, the same parts as those in the metal halide lamp shown in FIG. 2 are designated by the same symbols and detailed explanations are omitted. In the third embodiment, the light emitting tube portion 11 is formed in such that the discharge space 13 is shifted downward with respect the outer surface of the light emitting tube portion 11 in the manufacturing process. As the result, the shape of the light emitting tube 11 in the cross section perpendicular to the tube axis shows that the wall thickness of the bottom portion is formed thinner than that of the upper portion.

Also in the third embodiment, the rise of light flux at lighting can be made quick and the total light flux can be increased by making the wall thickness A1 of the bottom portion and the wall thickness A2 of the ceiling portion to satisfy the relation expressed by the following formula;

$$A1<A2$$

The present invention is not limited to the embodiments mentioned above and various modifications can be possible including the following modifications, for example.

Although the flat surface 111 of outer lower portion of the light emitting tube portion 11 shown in the first and the second embodiments is most preferably located horizontally, however, inclination of about 2° to 3°, for example, may be allowed, because the effect of the present invention is obtained in the case.

The flat surface may be formed by mechanical grinding of the outer lower portion of the light emitting tube portion 11, or by using such a chemical means as dissolving with chemicals, instead of cutting with the laser.

Further, in the process of forming the glass by heating in the third embodiment, glass material may be put in a mold for light emitting tube portion and may be sintered.

Further, the discharge space 13 may be nearly circular in the cross section, with which a similar effect to the present invention can be obtained. Here, the word "nearly circular" means that even a somewhat deformed circle can be allowed if there are no corners such as those in polygon.

Further, an infrared reflecting material such as an oxide such as tantalum pent oxide, for example, may be coated on inner surface of the bottom portion of the light emitting tube portion 11. With this coating, infrared light reflected at the bottom portion of the light emitting tube portion 11 during lighting can be utilized for raising the bottom temperature. A higher effect can be obtained, if the above oxide and silica are alternately laminated in a plurality of layers.

The invention claimed is:

1. A metal halide lamp comprising:

a translucent air tight vessel having a light emitting tube portion, in which a discharge space is formed, and sealed portions formed on both ends of the light emitting tube portion;

a discharge medium enclosed inside the discharge space containing at least metal halide and rare gas; and a pair of electrodes sealed in the sealing portion one ends of which are arranged facing each other in the discharge space;

wherein a shape of the light emitting tube portion forming the discharge space in a cross section perpendicular to a tube axis is nearly circular, wherein a shape of the bottom portion in the vertical cross section along the tube axis of the light emitting tube portion composed of a parallel portion, which is nearly parallel with the tube axis and has a lowest level at a portion between the pair of electrodes, and a tapered portion, which is gradually rising to the tube axis on both sides of the parallel portion, thereby accumulating the discharge medium on the bottom portion of the light emitting tube portion, wherein a wall thickness of the bottom portion of the light emitting tube is formed thinner than a wall thickness of a ceiling portion of the light emitting tube and wherein a wall thickness A1 of the bottom portion of the light emitting tube portion and a wall thickness A2 of a ceiling portion of the light emitting tube portion are designed to satisfy the relation expressed by the following formula;

$$0.2 \leqq A1/A2 \leqq 0.8.$$

2. A metal halide lamp according to claim 1, wherein a distance X from nearly center of a distance between the pair of electrodes to the bottom portion in the light emitting tube portion is equal to or larger than a distance Y from an end of the pair of electrodes to the bottom portion in the light emitting tube portion; and wherein a length d of the bottom portion, which is substantially parallel with the tube axis direction in the light emitting tube portion is equal to or less than a distance D between the ends of the pair of electrodes.

3. A metal halide lamp according to claim 1, wherein the light emitting tube portion has at least a flat surface formed on an outer lower portion.

4. A metal halide lamp according to claim 3, wherein the flat surface is formed by removing a part of the lower portion of the light emitting tube portion, which is substantially of rotational symmetry with the tube axis.

5. A metal halide lamp according to claim 3, wherein the flat surface is formed substantially in parallel with a pinch surface of the sealed portion.

6. A metal halide lamp comprising:

a translucent air tight vessel having a light emitting tube portion, in which a discharge space is formed, and sealed portions formed on both ends of the light emitting tube portion;

a discharge medium enclosed inside the discharge space containing at least metal halide and rare gas; and a pair of electrodes sealed in the sealing portion one ends of which are arranged facing each other in the discharge space;

wherein a shape of light emitting tube portion forming the discharge space in a cross section perpendicular to tube axis is nearly circular, wherein a shape of the bottom portion in the vertical cross section along the tube axis of the light emitting tube portion composed of a parallel portion, which is nearly parallel with the tube axis and has a lowest level at a portion between the pair of electrodes, and a tapered portion, which is gradually rising to the tube axis on both sides of the parallel portion, thereby accumulating the discharge medium on the bottom portion of the light emitting tube portion;

wherein a wall thickness of the bottom portion of the light emitting tube is formed thinner than a wall thickness of a ceiling portion of the light emitting tube;

wherein the light emitting tube portion has at least a flat surface formed on an outer lower portion;

wherein the flat surface is formed substantially in parallel with a pinch surface of the sealed portion; and wherein the flat surface is formed by removing a part of the lower portion of the light emitting tube portion, which is substantially of rotational symmetry with the tube axis.

7. A metal halide lamp according to claim 6 wherein a wall thickness A1 of the bottom portion of the light emitting tube portion and a wall thickness A2 of a ceiling portion of the light emitting tube portion are designed to satisfy the relation expressed by the following formula:

$$0.2 \leqq A1/A2 \leqq 0.8.$$

8. A metal halide lamp according to claim 1, wherein the wall thickness A1 of the bottom portion of the light emitting tube portion and the wall thickness A2 of the ceiling portion of the light emitting tube portion are designed to satisfy the relation expressed by the following formula:

$$0.2 \leqq A1/A2 \leqq 0.65.$$

* * * * *